US006186743B1

(12) United States Patent
Romer

(10) Patent No.: US 6,186,743 B1
(45) Date of Patent: Feb. 13, 2001

(54) MULTIPLE PUMP SEQUENCING CONTROLLER

(75) Inventor: Kevin J. Romer, Middletown, VA (US)

(73) Assignee: American Manufacturing Co., Inc., Manassas, VA (US)

( * ) Notice: Under 35 U.S.C. 154(b), the term of this patent shall be extended for 0 days.

(21) Appl. No.: 09/433,871

(22) Filed: Nov. 4, 1999

(51) Int. Cl.[7] ..... F04B 41/06

(52) U.S. Cl. ..... 417/3; 417/7; 417/8; 417/63; 361/191; 361/192; 427/256; 73/40.5 R

(58) Field of Search ..... 417/3, 7, 8, 63; 361/191, 192; 427/256; 73/40.5 R

(56) References Cited

U.S. PATENT DOCUMENTS

| | | | | |
|---|---|---|---|---|
| 1,672,690 | | 6/1928 | Runner . | |
| 1,842,641 | | 1/1932 | Adams . | |
| 2,482,496 | | 9/1949 | McGillivray . | |
| 2,803,192 | | 8/1957 | Crabtree . | |
| 3,744,932 | | 7/1973 | Prevett . | |
| 3,751,185 | | 8/1973 | Gottliebson et al. . | |
| 4,297,081 | * | 10/1981 | Irvin | 417/8 |
| 4,341,983 | | 7/1982 | Gottliebson . | |
| 4,368,502 | * | 1/1983 | Jornod et al. | 361/192 |
| 4,551,068 | * | 11/1985 | Boudreaux | 417/63 |
| 4,705,456 | * | 11/1987 | Gardeen | 417/7 |
| 4,897,022 | | 1/1990 | Hudson . | |
| 5,100,699 | * | 3/1992 | Roeser | 427/256 |
| 5,375,454 | * | 12/1994 | Andrejasich et al. | 73/40.5 R |
| 5,909,352 | * | 6/1999 | Klabunde et al. | 361/191 |

* cited by examiner

*Primary Examiner*—Timothy S. Thorpe
*Assistant Examiner*—Steven Brown
(74) *Attorney, Agent, or Firm*—McGuireWoods LLP

(57) ABSTRACT

A sequential controller is provided for sequencing multiple electric loads such electric pumps. That is, for each cycle the next load is designated as the lead load in a round-robin fashion. The controller uses cost effective electro-mechanical relay logic an thus avoids conventional solid state technology. In order to sequence the loads on each successive cycle, the electro-mechanical relay connected to the sensors comprises a double-throw contact set. The double-throw contact set comprises two complementary contacts, both of which alternate between normally open and normally closed on each successive cycle. In this manner one each successive cycle, the pumps designated as the lead pump and the lag pump automatically alternate in a round-robin fashion. Further, when the lead pump is disabled the lag pump is immediately actuated without disruption of service.

9 Claims, 4 Drawing Sheets

MULTIPLE PUMP SEQUENCING CONTROLLER

BACKGROUND OF THE INVENTION

1. Field of the Invention

The present invention generally relates to a controller for controlling the operational sequence of electrical loads and, more particularly, to a sequencing controller using electro-mechanical relays to control the operational sequence of multiple pumps in, for example, a septic system.

2. Description of the Prior Art

There are many applications for which it is desirable to sequence the operation of multiple electrical loads such as the sequential operation of multiple pumps used for an on-site septic system. In a simple septic system once waste water is ejected from a building it flows through the waste pipe and into a septic tank. Solids settle to the bottom of the tank to be broken down by an anaerobic process and clarified water effluent escapes the tank from an effluent pipe positioned opposite the waste pipe. The effluent is then channeled by a distribution box to various tubes fanned out below the surface of the ground in a drain field where it is allowed to leach slowly into the ground. For simple systems the entire system operates by gravity carrying the waste water from the building at the highest point to the drain field at the lowest point.

For systems which require waste water to move up hill at some point, a pump system is required to overcome the effects of gravity. In this situation, waste water is discharged into a pump chamber. When the water reaches a predetermined upper level, a float switch actuates a pump which continues to operate until the water is emptied to a predetermined lower level tripping another float switch. The amount of water pumped is referred to as the "dosing volume" and may be adjusted by changing the distance between the upper and lower levels where the pump switches on and off, respectively. If the pump fails to operate once the water reaches the upper level and the water continues to rise, a fail safe switch will be tripped sounding an alarm condition. If a redundant pump is available it may be activated at this time.

Complicated or larger systems, such as municipal systems, usually require more than one pump at a given location. Additional pumps may be provided simply for redundancy or to reduce the load on each individual pump and maintain even wear. For example if one pump is out of service, the remaining pump or pumps can maintain the load. Multiple pumps may also be required if the waste water is to be pumped to multiple destinations. Often in larger systems one drain field cannot leach enough water to support the entire system. Therefore, each time the pump chamber fills, pumps are rotated into and out of service in a round-robin fashion to pump the effluent to a different drain field. This rotating sequence occurs on each liquid level rise and fall cycle. The first pump in a given cycle sequence is referred to as the lead pump and the next pump in the sequence is referred to as the lag pump. As an added precaution, should the liquid level continue to rise even with the lead pump operating, a fail safe float switch may be provided causing the lag pump (presently idle) to energize and remain energized until the liquid level recedes sufficiently to de-energize both pumps.

Typically in such systems a pump selector switch is provided for each pump to allow manual or automatic control of the pump. However, when a given pump selector switch is placed in the off position (generally for maintenance purposes), the operation of the system is delayed until the liquid level reaches the fail safe float switch, causing the lag pump to activate. An additional and usually optional selector or circuit is required to cause the removed pump to be bypassed in the rotational sequence. Otherwise an interruption in operation will occur each time the given pump is called for but unavailable. This is obviously an undesirable situation. First, if the lag pump is not actuated until the liquid level rises above the fail safe float switch, the drain field to which the lag pump pumps may be overdosed by the extra liquid. This happening on a continual basis may cause flooding damage to the drain field. Further, typically an alarm is sounded when the liquid reaches the fail safe measure. Listening to and resetting this alarm each cycle would be annoying to the point where the operator may simply disable the alarm. In this situation, the pump system may continue to operate in its compromised condition causing damage to the system and possibly complete system failure.

SUMMARY OF THE INVENTION

It is therefore an object of the present invention to provide a controller for sequencing the operation of multiple loads in a round-robin fashion and automatically bypass disabled loads using electro-mechanical relay logic thereby avoiding solid state circuitry, conventional alternators, and timing relays.

It is yet another object of the present invention to provide a sequential controller using standard relay logic in a more cost effective manner conventional controllers.

It is yet another object of the present invention object of this invention is to allow one or more loads to be manually removed from the sequence without causing a delay in operation.

According to the invention, a sequential controller is provided for sequencing multiple loads. That is, for each cycle designating the next load as the lead load in a round-robin fashion. Disabled loads are automatically skipped over in favor of the next available load with no delay in operation. The invention is illustrated with the loads being electric pumps. Of course the inventive controller is not limited to pump systems, but may find application anywhere multiple loads need to be sequenced.

For a pumping application, a plurality of pumps are provided for pumping liquid, such as septic effluent, from a tank. For each rise and fall cycle of the liquid a first pump is designated as the lead pump and the next pump in the sequence is designated as the lag pump. When the liquid rises to a sufficient level, a "pump on" float switch actuates the lead pump which continues to pump until the liquid level falls to a predetermined level sensed by "pump off" float switch. In the next cycle, the lag pump from the previous cycle is automatically designated as the lead pump and, for a two pump application, the lead pump from the previous cycle is designated as the lag pump. If the liquid continues to rise even though the lead pump is operating, an alarm/lag pump float switch is tripped causing the lag pump to actuate. In this situation, both the lead pump and the lag pump continue to operate until the liquid level recedes enough to be detected by the pump off float switch. If one of the pumps in the system is taken out of service (usually for maintenance) the lag pump is automatically designated as the lead pump without causing a delay in operation.

The controller of the present invention uses cost effective electro-mechanical relay logic an thus avoids conventional solid state technology. In order to sequence the loads on each successive cycle, the electro-mechanical relay connected to the sensors comprises a double-throw contact set. The double-throw contact has two complementary contacts, both of which alternate between normally open and normally closed on each successive cycle. In this manner one each successive cycle, the pumps designated as the lead pump and the lag pump automatically alternate in a round-robin fashion.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
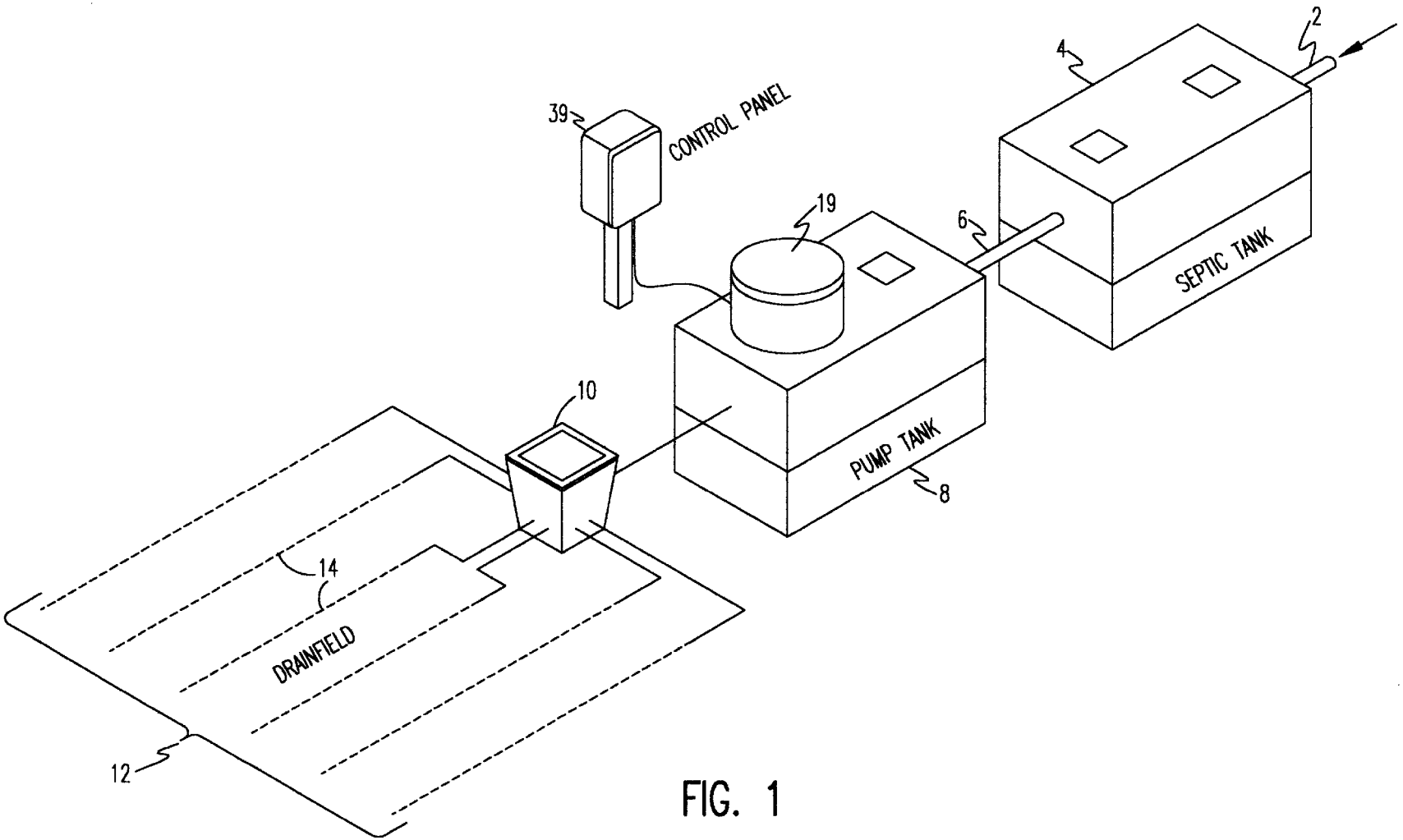
FIG. 1 is a perspective view of a diagram of an on-site septic system.

Referring now to the drawings, and more particularly to FIG. 1, there is shown a perspective view of an exemplary on-site septic system. Waste water flows through an inlet 2 and into a treatment tank 4. The treatment tank may be of any suitable type, such as a standard septic tank which acts as an anaerobic holding tank, or it may be an aeration system providing aerobic treatment to the waste water stream, or any other type of treatment system. Solids settle to the bottom of the tank to be broken down by an anaerobic process and clarified water effluent escapes the tank from a pipe 6 to the dosing tank or pump tank 8 which receives the effluent on the demand of the system. The level of effluent in the dosing tank 8 is sensed by the system controller 39 through level switches, as shown in more detail in FIG. 3. When the level of the effluent reaches a predetermined level, pumps (shown in FIG. 2) pump the effluent to a distribution box 10 for distribution to the drain field 12. The drain field 12 comprises rows of buried pipes 14 having holes cut along their length for allowing water to leach into the ground in a slow controlled fashion. A media bed (not shown) such as a sand filter may optionally be required to treat the effluent before final disposal in the drain field 12.

Figure 2:
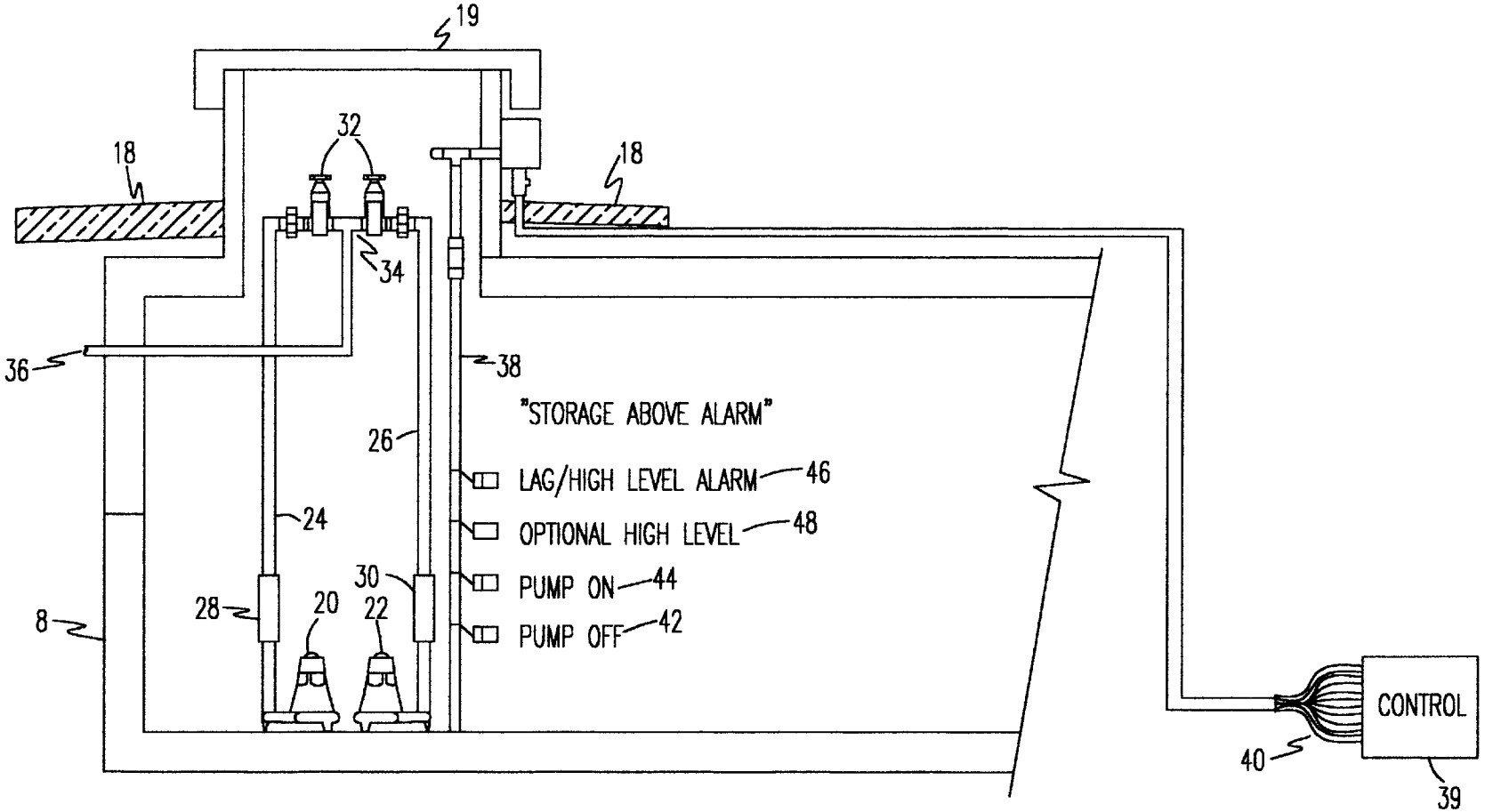
FIG. 2 is a diagram dose tank having multiple pumps to be sequentially operated to remove effluent from the tank.

FIG. 2 shows an expanded view of the dose tank 8. The tank 8 is buried under the ground 18 and comprises an access cap 19 protruding above the ground. At least two pumps 20 and 22 sit near the bottom of the tank 8. Pipes 24 and 26 connect to the pumps 20 and 22, respectively, for pumping effluent from the tank. Check valves 28 and 30 keep the effluent in the pipes from flowing backwards into the tank 8. The pipes 24 and 26 are connected by turn-off valves 32 at T-fitting 34 and exit the tank 8 at the outlet pipe 36. For purposes of illustration a duplex system is shown comprising only two pumps. However, it is understood that the sequential controller of the present invention may operate with more than two pumps as the application warrants.

A conduit 38 runs the depth of the tank 8 and has positioned thereon sensors along its length for sensing the effluent level in the tank 8. Wires 40 connect the sensors, such as float switches, to the controller 39 (shown in detail in FIG. 3). Three switches and an optional forth are used to control, by volume, each dose to be discharged. The dosing volume is adjustable by increasing or decreasing the distance between the pump off switch 42 and the pump on switch 44. If the water level rises high enough to overcome pump on switch 44, the lead pump (20 or 22) will activate and continue to run until the water level drops below the pump off switch 42. The control will then alternate the lead pump (20 or 22) of successive rise and fall cycles. If the water level continues to rise and reaches the lag pump switch 46, an alarm will sound and the lag pump (presently idle pump 20 or 22) will activate such that both pumps 20 and 22 will continue to operate until the water level drops below the pump off switch 42. An optional high level switch 48 may be provided below the high level/alarm switch 46 to activate the lag pump to reduce the amount of water in the tank in an effort to avoid tripping the alarm.

Figure 3:
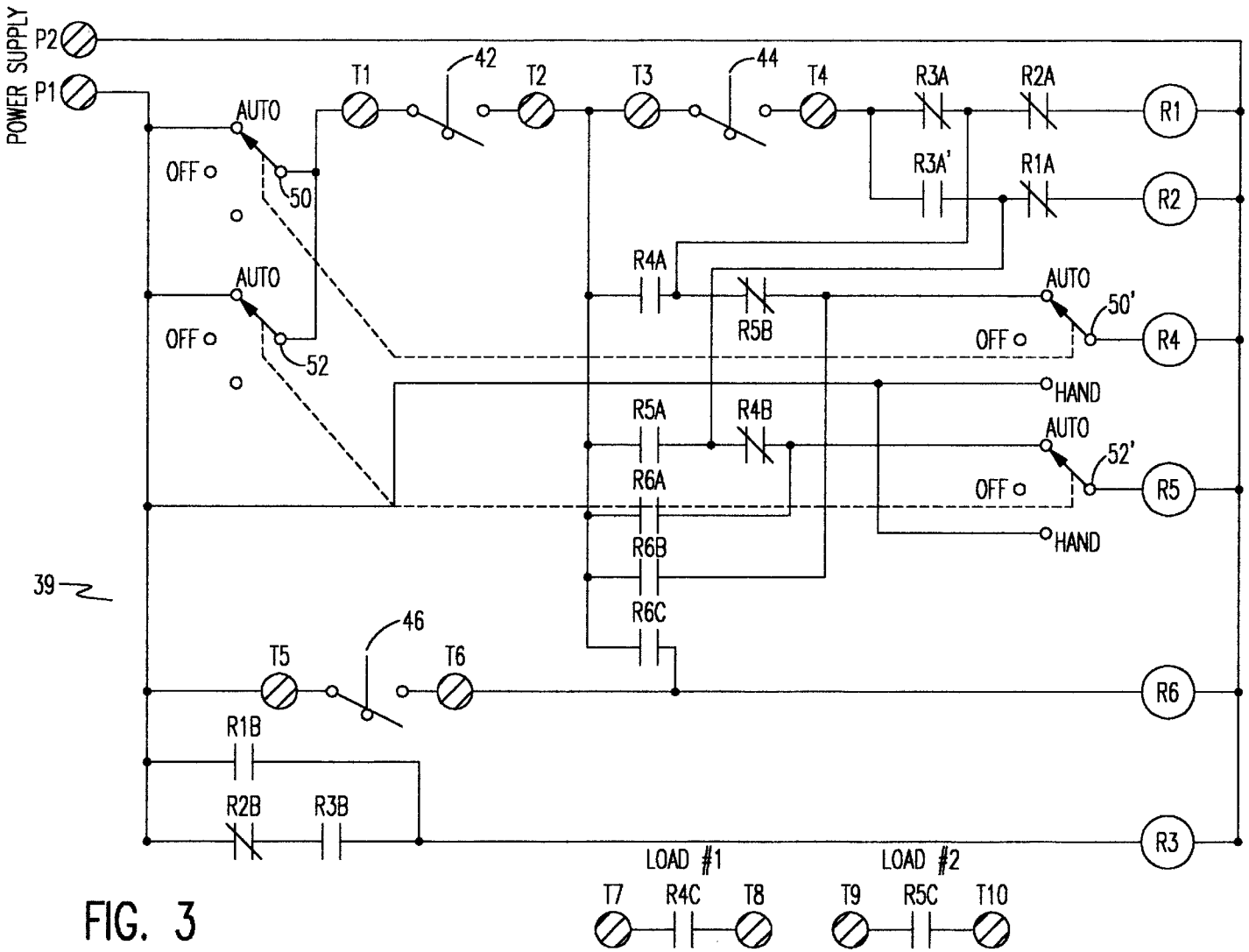
FIG. 3 is a circuit diagram of a controller for controlling with relays the operation sequence of multiple pumps.

Referring now to FIG. 3, there is shown a sequential controller 39 for controlling with relays the operation sequence of multiple pumps 20 and 22. Each pump connected to the controller has a three-way switch 50 and 52 for automatic operation, manual operation and pump off. Each of these switches 50 and 52 effect two portions of circuit as illustrated by the dashed lines connecting switched 50 and 52 to 50' and 52'. Typically the off position is selected if the effected pump is being serviced.

In operation, beginning with all switches (50 and 52) in the "off" position, all relay contacts (designated Rxx) will be in a de-energized state. Placing both switches 50 and 52 in the "auto" position closes the switch contacts, applying power to terminal T1. As the water level in the dose tank rises, the pump off float switch 42 makes closure across terminals T1 and T2 and applies power to terminal T3 as well as applies power to normally open relay contacts R4A, R5A, R6A, R6B, and R6C. When the water level rises and reaches float switch 44, the contact closes across terminals T3 and T4 to initiate the sequence by applying power through normally closed contacts R3A, R2A, and R5B, thus activating relay coils R1 and R4. Normally open contact R4C is immediately closed, generating an output signal across terminals T7 and T8 to activate Load 1 (either pump 20 or 22) . Normally closed contacts R1A and R4B are immediately forced open, preventing power from reaching the coils of relays R2 and R5. Normally open contact RIB is also immediately closed, activating relay coil R3. Relay coil R3 will remain latched on through normally closed contact R2B and normally open (now closed) contact R3B.

Contact R3A and R3A' is a double throw contact capable of changing its normally open or normally closed state to the opposite each cycle. Here, normally open and normally closed contacts R3A and R3A' will change state, allowing power from terminal T4 to pass through normally open contact R3A (now closed) to normally closed (now open) contacts R1A and R4B and normally open contact R5A, having no operational affect. Relay coil R4 will remain latched on through normally closed contact R5B, normally open (now closed) contact R4A, and the closed circuit across terminals T1 and T2. Opening of the contact closure across terminals T3 and T4 shall have no affect other than removing power from contacts R1A, R4B, and R5A. All other relay coils and contacts shall maintain their current state until the removal of the contact closure across terminals T1 and T2, or until opening of the contact closure created by having the switch in the "auto" position. Opening of the contact closure across terminals T1 and T2 shall remove power from all relay coils and contacts except relay coil R3 which will remain latched in through contacts R2B and R3B. Opening of contact R4C shall terminate the signal for Load L1, thus de-activating it. Re-applying contact closure across terminals T1/T2 and T3/T4 allows power to pass through the normally open (now closed) contact R3A, activating relay coils R2 and R5 in the same manner as R1 and R4 had been originally. Contact R5C shall immediately close, activating Load L2 attached to terminals T9 and T10. Normally closed contact R2B shall immediately open, removing power from the latching circuit that had been holding relay coil R3 latched on. As described earlier, the relay coils and contacts will maintain their present state until removal of contact closure across terminals T1/T2. More simply stated, the latching and unlatching of relay coil R3, causing double throw contacts R3A and R3A' to reverse state upon each opening and closing of inputs on terminals T1/T2 and T3/T4, shall cause loads L1 and L2 to alternate lead and lag. An advantage to the present invention is that it permits one of the loads to be manually removed from the sequence without causing a delay in operation. Opening of the contact closure across the "auto" switch 50 or 52 of a load causes the load output contacts to immediately switch from the currently activated load to the currently de-activated load. For example, with relay coil R4 energized and latched in as described above, removal of the contact closure across "auto" switch 50 causes contact R4A to open, disallowing power to pass through contact R2A and causing relay coil R1 to be de-energized. With normally open contact R3A having been previously closed and normally closed contact R1A now being closed, power will pass through contact R1A, activating relay coil R2. Activation of relay coil R2 will cause the same affect on related contacts as described earlier, causing load L2 to activate. In future sequences, with switch 50 remaining open, load L2 will continuously be activated in the same sequence as described above, until such time that switch 50 contacts are again closed, causing the loads to resume an alternating sequence.

If the water level rises to the lag/high level alarm float switch 46, a contact closure across terminals T5/T6 causes relay R6 to activate closing contacts R6A, R6B, and R6C. In this event, power is applied directly and simultaneously to the coils of relays R4 and R5, assuming that their respective "auto" switches are closed. Relay coil R6 shall remain latched on through contact R6C and terminals T1/T2, until removal of contact closure across terminals T1/T2.

Figure 4:
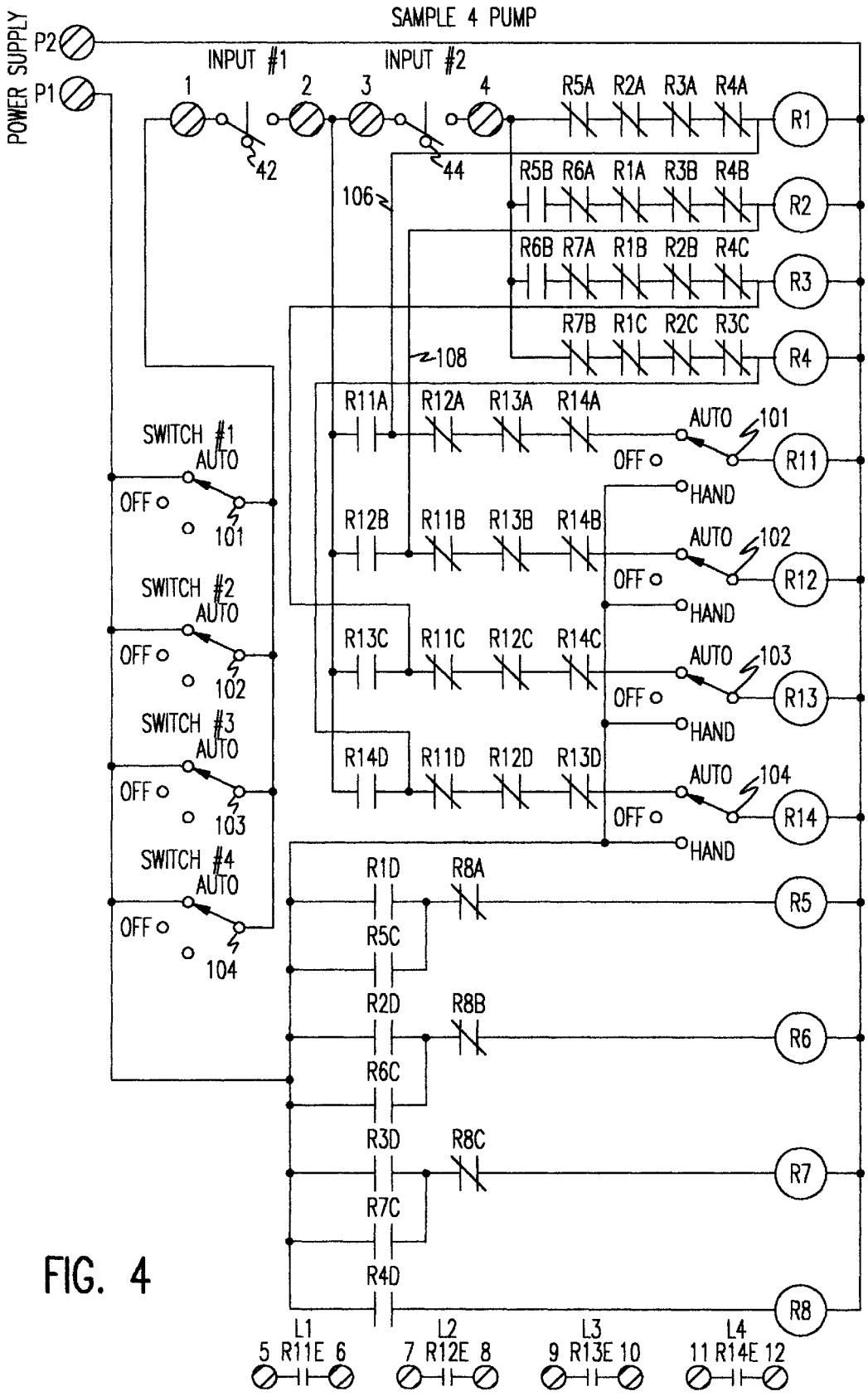
FIG. 4 is a circuit diagram of a controller for controlling the sequential operation of up to four pumps.

For simplicity of illustration, the invention is shown for two loads L1 and L2. However, an infinite number of loads may be added simply by expanding the relay circuit for each additional load desired. For example, FIG. 4 shows the circuit having four loads, L1–L4. The basic operation of the circuit is the same as that shown for the two load application shown in FIG. 3 and therefore the operation is not repeated in detail. It will be noted that for each load, L1–L4, present in the circuit, three relays are used. The first group of relay coils R1–R4 connect to the float switches 42 and 44. The second group of relay coils R11–R14 are connected to switches 101–104, respectively, and when energized activate the loads L1–L4, respectively. The third set of relay coils R5–R8 when energized cause respective contacts connected to the first set of relay coils R1–R4 to switch states such that in the next cycle, the next load will become the lead load. As a simple example, in an initial state let L1 be the lead load. When the float switches 42 and 44 are tripped, power will flow through normally closed contacts R5*a*, R2*a*, R3*a*, and R4*a*, through connection 106, through normally closed contacts R12*a*, R13*a*, and R14*a*, to energize relay coil R11 when switch 101 is in the auto position. Load L1 is connected across terminals T5 and T6. Therefore, when contact R11*e* closes lead load L1 will be energized. Contact R11*a* also closes, switching the power supply to switch 101 from float switch 44 to float switch 42. Simultaneously, relay coil R1 is energized causing normally closed contacts R1*a*, R1*b*, and R1*c* to open preventing current from flowing to relay coils R2–R4. Further, contact R1*d* closes supplying power to relay coil R5 thereby switching contact R5*a* from normally closed to normally open and R5*b* from normally open to normally closed such in the next cycle, load L2 will be designated as the lead load.

As described above, an advantage to this circuit is that if any one of the load switches 101–104 is placed in the off position, for example to take a load out of service for maintenance, this load will simply be automatically skipped over and the next load in the sequence will become the lead load. For example, suppose in the example above, load L1 is taken out of service by placing switch 101 in the off position. In this case, R11 will not be energized, R11*e* will not close, and load L1 will not activate. However, relay coil R1 will energize as before causing contact R1*d* to close, energizing relay coil R5. At that instant, contact R5*b* will close, energizing relay coil R2 and, through connection line 108 energize relay coil R12, immediately closing contact R12*e* and bringing load L2 into service. The loads cycle through in this round robin fashion automatically skipping over disabled loads and immediately bringing into service the next available load without need of an additional selector or circuit. Hence, no interruption of operation will occur when a given load is called but unavailable.

While the invention has been described in terms of a single preferred embodiment, those skilled in the art will recognize that the invention can be practiced with modification within the spirit and scope of the appended claims.

I claim:

1. A multiple load sequence controller for alternating loads for each successive sequence cycle, comprising:

sensor means for sensing a condition requiring a load to be activated;

a first relay connected to receive power from said sensor means, said first relay including a double throw contact set having a first normally closed contact and a first normally open contact, wherein energizing said first relay causes said double throw contact set to change states;

a second relay connected to receive power through a first switch via said first normally closed contact of said double throw contact set, wherein when said second relay is energized a first load is actuated and said first coil is energized causing said double throw contact set to change states; and a third relay connected to receive power through a second switch via said first normally open contact of said double throw contact set, wherein when said third relay is energized on a successive cycle a second load is actuated, wherein when either said first switch or said second switch is placed in an off position said first relay causes power to flow to the other of said first or said second switch.

2. A multiple load sequence controller as recited in claim 1, wherein said sensor means comprises a first sensor for sensing a first condition to initiate a cycle and a second sensor for sensing a second condition to end a cycle.

3. A multiple load sequence controller as recited in claim 2 wherein said sensing means further comprises a third sensor for sensing a condition requiring both said first load and said second load to be actuated concurrently.

4. A multiple load sequence controller as recited in claim 2 wherein said first load and said second load are electric pumps.

5. A multiple load sequence controller as recited in claim 4 wherein said first sensor is a float switch for sensing a high liquid level to actuate pumping and said second sensor is a float switch for sensing a lower liquid level to stop pumping.

6. A sequence controller for alternating the operation of a plurality of pumps for each successive sequence cycle, comprising:

a first relay comprising a first coil R1, a normally closed contact R1A and a normally open contact R1B;

a second relay comprising a second coil R2, a normally closed contact R2A and a normally open contact R2B;

a third relay comprising a third coil R3 a double throw contact set having a first normally closed contact R3A and a first normally open contact R3A', and a normally open contact R3B;

a fourth relay comprising normally open contacts R4A and R4C, and a normally closed contact R4B;

a fifth relay comprising a normally open contacts R5A and R5C, and a normally closed contact R5B;

a first pump terminal connected across R4C and a second pump terminal connected across R5C;

a first sensor connected to a power supply for sensing a lower liquid level at which to stop pumping; and a second sensor connected to said first sensor for sensing a high liquid level at start pumping;

a first switch for connecting R5B and R4 in a first automatic position, disconnecting R4 from power in a second off position for disabling said first pump terminal controlled by R4, and a third manual position for connecting R4 directly to power for manually supplying power to said first pump terminal controlled by R4; and a second switch connecting R4B and R5 in a first automatic position, disconnecting R5 from power in a second off position for disabling said second pump terminal controlled by R5, and a third manual position for connecting R5 directly to power for manually supplying power to said second pump terminal controlled by R5, wherein R3A, R2A, and R1 are connected in parallel with R3A', R1A and R2, R4A, R5B and R4 are connected in parallel with R5A, R4B and R5, and R4A and R5B are connected at a point between said first sensor and said second sensor, R3A is connected to R4A, R3A' is connected to R5A', and R1B is connected in parallel with R2B and R3B to provide a power path for R3.

7. A sequence controller for alternating the operation of a plurality of pumps for each successive sequence cycle as recited in claim 6 further comprising:

a third sensor connected to said power supply for sensing an alarm water level above said high liquid level; and a sixth relay comprising a relay coil R6 and a plurality of normally open contacts connected to supply power to first switch and said second switch in said first automatic position, wherein when said third sensor is actuated R6 is energized closing said normally open contracts for supplying power to said first pump terminal and said second pump terminal.

8. A method for sequencing the operation of a plurality of electric loads with relays, comprising the steps of:

providing at least two loads for alternating between lead load and lag load;

providing a switch associated with each load for taking the load into and out of service;

sensing a first condition with a first sensor;

sensing a second condition with a second sensor and supplying power to said lead load via said associated switch to start a cycle through a double throw contact set having a first normally closed contact and a first normally open contact;

energizing a first relay coil to begin supplying power to said lead load through said first sensor;

energizing a second relay coil for changing the state of said double throw contact, wherein on a next cycle said lead load will be designated as the lag load and said lag load will be designated as the lead load; and skipping said lead load when said associated switch is in an off position and immediately activating said lag load.

9. A method for sequencing the operation of a plurality of electric loads with relays, comprising the steps of:

connecting a first load to be initiated by a first relay;

connecting a second load to be initiated by a second relay;

providing a third relay including a double throw contact set having a first normally closed contact and a first normally open contact each connected to one of said first and second relays, a load corresponding to normally closed contact being designated as the lead load and the other as the lag load;

energizing said double throw contact set to energize one of said first and second relays connected to said normally closed contact;

alternating the lead load and the lag load on successive cycles by energizing said third relay to cause said double throw contact set to change states wherein said normally open contact becomes normally closed and said normally closed contact becomes normally open;

providing a switch associated with each of said lead and lag loads;

automatically actuating the lag load when said switch associated with said lead load is disabled.

* * * * *